United States Patent [19]

Ibrahim

[11] 4,439,992

[45] * Apr. 3, 1984

[54] OPEN TOP REFRIGERATED CASE WITH DEFROST AIR INTAKE AND COLLIDING BAND AIR DEFROST

[75] Inventor: Fayez F. Ibrahim, Niles, Mich.

[73] Assignee: Tyler Refrigeration Corporation, Niles, Mich.

[ * ] Notice: The portion of the term of this patent subsequent to Jul. 6, 1999 has been disclaimed.

[21] Appl. No.: 395,480

[22] Filed: Jul. 6, 1982

Related U.S. Application Data

[63] Continuation-in-part of Ser. No. 226,768, Jan. 21, 1981, Pat. No. 4,337,626, which is a continuation-in-part of Ser. No. 145,859, May 1, 1980, Pat. No. 4,314,457, which is a continuation-in-part of Ser. No. 107,261, Dec. 26, 1979, Pat. No. 4,265,092, Ser. No. 76,669, Sep. 18, 1979, Pat. No. 4,314,453, and Ser. No. 60,459, Jul. 25, 1979, Pat. No. 4,295,340, and a continuation-in-part of Ser. No. 295,542, Aug. 24, 1981, which is a continuation-in-part of Ser. No. 11,804, Feb. 14, 1979, abandoned.

[51] Int. Cl.[3] ..... A47F 3/04

[52] U.S. Cl. ..... 62/82; 62/256

[58] Field of Search ..... 62/256, 82, 282

[56] References Cited

U.S. PATENT DOCUMENTS

| | | | |
|---|---|---|---|
| 2,929,227 | 3/1960 | Rainwater | 62/256 |
| 4,106,305 | 8/1978 | Ibrahim | 62/256 X |
| 4,120,174 | 10/1978 | Johnston | 62/256 |
| 4,182,130 | 1/1980 | Ljung | 62/256 X |
| 4,271,680 | 6/1981 | Karashima | 62/256 |
| 4,320,631 | 3/1982 | Vana | 62/256 |
| 4,337,626 | 7/1982 | Ibrahim | 62/256 X |

*Primary Examiner*—William E. Tapolcai

*Attorney, Agent, or Firm*—LeBlanc, Nolan, Shur & Nies

[57] ABSTRACT

A well type open top refrigerated display case has a primary air conduit extending around the cabinet and main fans for circulating air through the primary conduit and across the open top of the cabinet in the form of an air curtain. Defrost fans are mounted in the case to draw ambient air from above the refrigerated display case into an upper portion of the primary conduit at a higher pressure than the air pressure in the region of the open top. Defrost control means are provided for energizing the defrost fans at the start of a defrost cycle to propel a portion of the higher pressure ambient air out of the primary conduit through an air opening to collide with an air curtain flowing across the open top, the flow of the air curtain being thereby reversed and caused to flow over the top of and outside the display case. A further portion of ambient air is drawn downwardly by the main fans to flow through the primary conduit and assist in defrosting the coils.

24 Claims, 6 Drawing Figures

OPEN TOP REFRIGERATED CASE WITH DEFROST AIR INTAKE AND COLLIDING BAND AIR DEFROST

CROSS REFERENCE TO RELATED APPLICATIONS

This application is a continuation-in-part of Ser. No. 226,768 filed Jan. 21, 1981 now U.S. Pat. No. 4,337,626 which is, in turn, a continuation-in-part of Ser. No. 145,859 filed May 1, 1980, now U.S. Pat. No. 4,314,457, which was, in turn, a continuation-in-part of Ser. No. 107,261 filed Dec. 26, 1979, now U.S. Pat. No. 4,265,092, Ser. No. 76,669 filed Sept. 18, 1979, now U.S. Pat. No. 4,314,453, and Ser. No. 60,459 filed July 25, 1979, now U.S. Pat. No. 4,295,340; and Ser. No. 295,542 filed Aug. 24, 1981 which is a continuation-in-part of Ser. No. 11,804 filed Feb. 14, 1979, now abandoned.

The entire disclosure of Ser. No. 226,768 and Ser. No. 295,542 and the disclosures of their respective parent applications are hereby incorporated by reference as though fully set forth herein.

BACKGROUND OF THE INVENTION

The present invention relates to air defrost systems for open top refrigerated display cases. More particularly, the invention relates to display cases having an air defrost system in which air bands are caused to flow in opposite directions in defrost to collide and direct defrost air outside the case and permit ambient air to flow over the refrigeration coils to defrost the same.

All references herein to refrigeration apparatus or refrigeration operations are intended to include cooling at a temperature below 32° F., such as associated with frozen food display cases, or below 0° F., such as with ice cream cases, or in excess of 32° F., such as typically associated with dairy, fresh meat and produce display cases.

The invention is primarily intended for use in, but is not limited to, island type display cases having an ambient air defrost system. Island type display cases are constructed essentially as open top cases with a central member which can include an air flue located in the well region for dividing the case into two parts. The island cases have the general appearance of two open top cases arranged back to back. Separate air conduits are provided for each display section, with the central member providing a common region between the otherwise distinct conduits. Generally, separate sets of refrigeration coils are provided in each conduit to cool the air flowing through the separate conduits during a refrigeration cycle.

In the operation of commercial refrigerated display cases, e.g. such as are found in supermarkets and the like, it is desirable to include a system capable of automatically defrosting the display case. Preferably, the defrost cycle is actuated either at preset periodic times or when the frost buildup within the system has reached a certain predetermined level. The system may be controlled to begin the defrost operation at a preset time or times as set on a master control clock; defrost termination is usually thermostatically controlled, with a fail-safe clock-controlled maximum defrost time period. Alternatively, the system may be thermostatically controlled so as to switch from the refrigeration cycle to the defrost cycle when a preset level of frost buildup is detected. By either manner of operation, it is possible to avoid significant frost buildup within the display case.

Typically, three main approaches have been employed in the past for defrosting refrigerated display cases. The first approach involves the use of electric resistance heaters that are arranged adjacent to the refrigeration coils of the refrigeration mechanism. During a defrost cycle, these heaters are energized to radiate heat in an effort to eliminate the frost buildup on the coils; this also adds heat to the air which can be circulated through the conduit within the case. This electric defrost is relatively simple both in construction and operation. No additional moving parts are required, although it is generally necessary to install an additional three-phase 220 V line for the heater circuit. The electrical heaters are high wattage heaters, and thus utilize a substantial amount of electricity during operation. Furthermore, the additional warm air being circulated in the case due to the radiant heat from the heaters can raise the temperature of the case above desirable limits, thereby increasing the risk of product spoilage.

A second type of defrost system in use circulates relatively high temperature, high pressure compressed gaseous refrigerant through selected evaporator coils during the defrost cycle in the opposite direction to the flow of refrigerant through the evaporator coils during the refrigeration cycle. During the defrost cycle, a valve mechanism shuts off the supply of low temperature liquid refrigerant to the evaporator coils to be defrosted and instead routes the compressed hot gaseous refrigerant through the coils for defrosting. Gas defrost requires additional mechanical components. All of these elements are subject to rapid and extreme temperature shifts, and resulting expansion, particularly at the start and end of a defrost cycle. Due to the requirement that the system be able to be selectively switchable to supply hot gaseous refrigerant to selected ones (but not all) the evaporator coils, a complicated valving and control structure must be provided.

A third, relatively recently developed approach to defrosting display cases relies upon naturally warm ambient air. An example of an ambient air defrosting system which has proven to be commercially successful is shown in U.S. Pat. No. 4,144,720 to Subera et al, which is assigned to the same assignee as the present invention. The Subera '720 patent discloses an open front refrigerated display case having primary and secondary air conduits. During a defrost cycle, the direction of air flow through the secondary conduit is reversed to draw in air from outside the display case. This ambient air is directed into the primary band conduit where it is forced to flow over the evaporator coils and defrost them. A feature of the system shown in the Subera '720 patent is that the primary band air flow is continuously maintained in both the refrigeration and defrost cycles, whereby an air curtain is maintained across the access opening at all significant times.

Other reversible fan air defrost systems are shown in U.S. Pat. No. 4,026,121 to Aokage et al, West German Offenleg. 2,123,646, and U.S. Pat. No. 4,120,174 to Johnston. Other air defrost systems generally are shown in U.S. Pat. Nos. 3,082,612, 3,403,525; 3,850,003; and 3,937,033, all to Beckwith et al and in U.S. Pat. No. 4,145,893 to Vogel. Open top island type display cases using air defrost are disclosed in U.S. Pat. Nos. 4,182,130 to Hans G. Ljung; 4,285,204 and 4,320,631 both to John H. Vana. The latter patent is fitted with a defrost air discharge fan which permits the air curtain established during a refrigeration cycle to continue during a defrost cycle.

U.S. Pat. No. 3,383,877 to Lieberman et al discloses a mutually exclusive air defrost or hot gas defrost system.

U.S. Pat. No. 2,929,227 to Rainwater shows a prior art open top island case.

SUMMARY OF THE INVENTION

The well type open top refrigerated display case of this invention includes primary air conduit means extending around the display space in the case, with air outlets and air inlets located on opposite sides of the display space. Refrigeration coils and main air circulating fans are located in the primary conduit means for circulating air through the primary conduit means and across the open top of the display space between the outlet and inlets in the form of an air curtain during a refrigeration cycle.

The display can be of either single or double well type construction. In double well type island cases a centrally located air flue is connected to the primary conduit means and forms an upward extension thereof. The air inlets of the primary air conduit means are positioned in the top portion of the air flue so that these inlets are near the same horizontal position as the air outlets in the primary air conduit means. Defrost ambient air intake means are arranged in communication with the primary conduit means to form a defrost air band which collides with the air curtain over the display space, causing this curtain to reverse and flow away from the case during a defrost cycle.

DESCRIPTION OF THE PREFERRED EMBODIMENT

Figure 1:
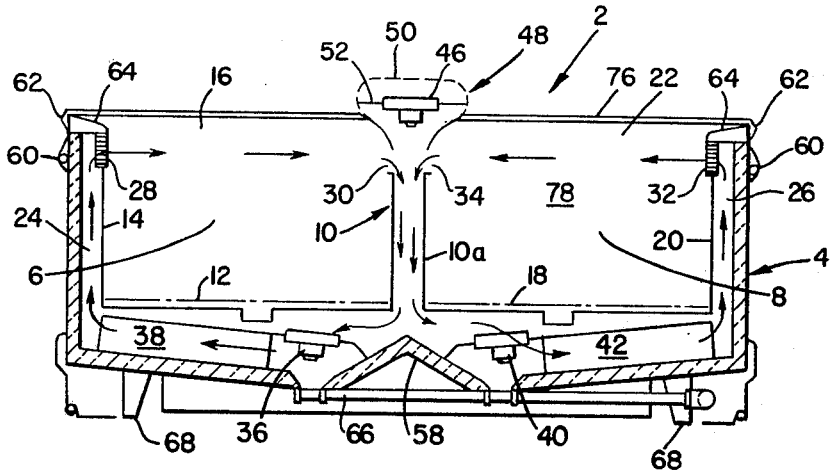
FIG. 1 is a schematic cross-sectional view of a double well type display case according to the present invention shown in a refrigeration cycle.

FIG. 1 shows a single band well type island case having an outer cabinet 4, containing back to back storage/display spaces 6 and 8, separated by a central air flue 10. Display space 6 is further defined by bottom and side wall panels 12 and 14, respectively, and a top access opening 16. Display space 8 is further defined by bottom and side wall panels 18 and 20, respectively, and by a top access opening 22.

A first primary air conduit 24 is formed in the space between the outer cabinet 4 and wall panels 12 and 14 of display space 6. A second primary air conduit 26 is formed in the space between the outer cabinet 4 and wall panels 18 and 20 of display space 8. Both conduits 24 and 26 share a common return defined by the hollow interior of central air plenum 10. An outlet 28, usually covered by a louvered grille, is disposed near the top of display space 6 along one side of top access opening 16. A corresponding return or inlet opening 30 is located across from outlet 28 in central air plenum 10. An air outlet opening 32, usually covered by a louvered grille, is disposed near the top of the display space 8 along one side of the top access opening 22. A corresponding return or inlet air opening 34 is located across from outlet 32 on the opposite side of top access opening 22 in central air plenum 10. The corresponding air inlet and outlet 28 and 30 for space 6 and 32 and 34 for space 8 act as air openings for the respective refrigerated air bands flowing in primary conduits 24 and 26.

A first fan or set of fans 36 and a first set of refrigeration coils 38 are located in conduit 24. A second fan or set of fans 40 and a second set of refrigeration coils 42 are located in conduit 26 analogously to fans 36 and refrigeration coils 38 located in conduit 24.

During the normal refrigeration cycle, air is propelled by fans 36 through conduit 24 over coils 38, in the direction of the arrows in FIG. 1, out through outlet opening 28 and across the top access opening 16 of display space 6 toward and into return or inlet 30. A continuous refrigerated air band is thus created, including an air curtain across top access opening 16. In like manner, fans 40 propel air through conduit 26 over refrigeration coils 42, out through outlet opening 32 in the direction shown by the arrows, across top access opening 22 and into inlet 34. A refrigerated air band thus circulates through conduit 26 and across the top access opening 22 in the form of a refrigerated air curtain.

A third fan or set of fans 46 is located at the top of central air plenum 10 to selectively draw ambient air from above the outer cabinet 4 (and refrigerated display spaces 6 and 8) into central air plenum 10 during a defrost cycle. These fans 46 and the associated air plenum housing 48 provide a defrost ambient air intake means to selectively propel ambient air into the air plenum 10.

During a normal refrigeration cycle, fans 46 are shut off and fans 36 and 40 generate and maintain continuous air bands through conduits 24 and 26, and air curtains across the open tops of display spaces 6 and 8, respectively.

At the start of a defrost cycle, the flow of refrigerant through coils 38, 42 is shut off. Concurrently, fans 46 are turned on to draw ambient air into central air plenum 10. Fans 36 and 40 continue to operate in the same manner as they do during the refrigeration cycle to maintain air flowing through conduits 24 and 26.

During the defrost cycle, with fans 46 operating to cause ambient air to flow downwardly through central air plenum 10, respective return or inlet ducts 30 and 34 are pressurized to a positive pressure with relatively warm air withdrawn from the ambient above the case. The size and/or number of fans 46 is sufficiently large that the volume of air flowing through the lower portion **10*a* of central column 10 (below inlet or return ducts 30 and 34) and through conduits 24 and 26 will be increased during the defrost cycle as compared to the refrigeration cycle. The increased warm air volume flowing over the refrigeration coils 38 and 42 aids in obtaining relatively rapid defrosting of the coils. The air plenum housing 48 has perforations 50 formed in the upper portion thereof and fans 46 are mounted in conventional spider baffles 52**.

During the defrost cycle, air flowing through conduits 24 and 26 gives up heat to coils 38 and 42. Obviously, if fresh air is not continuously introduced into the air bands in conduits 24 and 26, the air flowing over coils 38 and 42 would soon contain insufficient heat to properly defrost the coils. To accomplish rapid and efficient air defrosting, therefore, particularly in low temperature (e.g. freezer) cases, it is desirable to continuously remove cold air from and introduce warm ambient air into the conduits. This desirable end is achieved by the defrost air flow shown in FIG. 2.

The air pressure inside plenum 10 is greater than the pressure outside the column in the region of inlets 30 and 34. A portion of the air flowing downwardly through the upper part of central plenum is directed out of inlet ducts 30 and 34 to intersect and collide with the air curtains flowing out of outlets 28 and 32. The air exiting from inlets 30 and 34 is travelling at a higher velocity and therefore has a greater momentum than the air exiting from outlets 28 and 32. The air curtain flow is thus forced to reverse upon itself and flow in the opposite direction over the top of and outside of cabinet 4. In this manner, relatively warm ambient air is continuously drawn into the conduits 24 and 26 to flow over and around coils 38 and 42 to defrost them. At the same time air which has already given up its heat to the coils is exhausted outside the case, away from the ambient air intake at the top of column 10.

In one exemplary embodiment, fans 46 draw air into plenum 10 at a volumetric rate approximately two times greater than the total volumetric flow rate of fans 36 and 40. For example, each set of fans 36 and 40 may draw air at a rate of about 100 cfm (cubic feet per minute); fans 46 would therefore draw air at a rate of about 400 cfm. Approximately one half the air entering plenum 10 exits from inlets 30 and 34 in about equal amounts (e.g. about 100 cfm per inlet).

The natural pressure differential occurring at inlets 30 and 34 between the higher pressure side on the inside of plenum 10 and the lower pressure side outside the plenum in display spaces 6 and 8, respectively, will be sufficient to naturally divert a portion of the air flow in plenum 10 out through inlets 30 and 34 into the path of the air curtains flowing across access openings 16 and 22 from conduit outlets 28 and 32. If necessary, however, guide vanes 54 and 56 (as shown in FIG. 2) could be provided at inlets 30 and 34 extending partially into the air stream in plenum 10.

Figure 2:
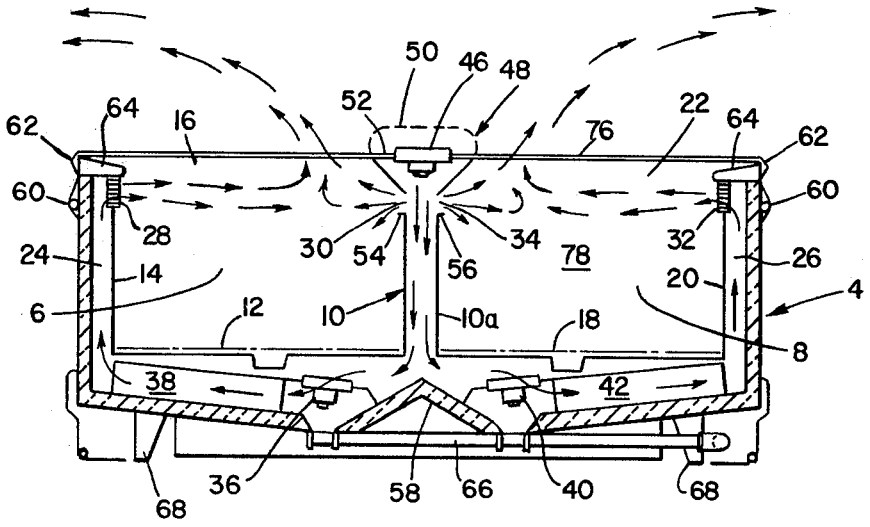
FIG. 2 is a schematic view of the display case of FIG. 1 shown in a defrost cycle with colliding air bands.

FIGS. 1 and 2 show separate sets of air circulating fans provided for each of the separate conduits 24 and 26 wherein each set of fans draws air from the common central air flue into the separate conduit sections.

An alternative is to provide a single set of air circulating fans at the junction between the central common air flue and the separate conduits to propel the air around the respective display space regions and across the separate open top regions. This junction is occupied by the inverted V-shaped bottom portion 58 in FIGS. 1 and 2.

Conventional guard bumpers 60, rub rails 62, conduit caps 64, drainage tubes 66, and feet 68 are provided for case 2.

Figure 3:
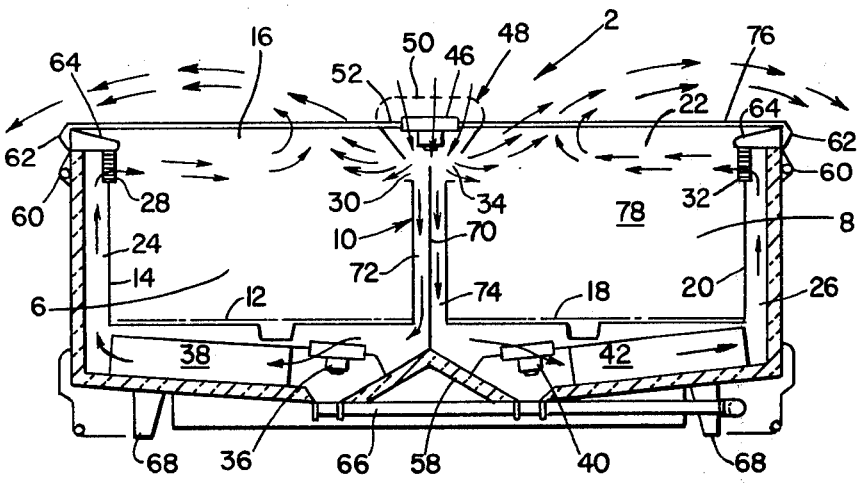
FIG. 3 is a schematic cross-sectional view of another embodiment of the display case according to the present invention shown in a defrost cycle wherein a divided central air plenum is used.

FIG. 3 shows a variation of a second embodiment of this invention. In this FIGURE, similar elements corresponding to those shown in the embodiment of FIGS. 1 and 2 and described above are designated by like referenced numerals. A modified refrigerated display case 2 is shown with a divider partition 70 located in the center portion of the air flue 10. This divider partition 70 rests on the inverted V-shaped bottom portion 58 and terminates at its upper end in the vicinity of the air openings 30 and 34. This divider partition forms a first air flue conduit 72 which extends primary air conduit 24 upward to the position of the air opening 30 and a second air flue conduit 74 which extends primary air conduit 26 upward to the position of the air opening 34.

The presence of the divider partition 70 in air flue 10 permits the double well type display cabinet of FIG. 3 to be operated during the refrigeration cycle at two different temperatures in the two wells 6 and 8. During defrost, the main fans 36 and 40 can be operated at different speeds in order to create a slightly different defrost condition due to the higher volume of defrost air moving therethrough. Also, it is possible to position divider partition 70 at various positions within the air flue 10 in order to effect the defrost rate for the two display spaces 6 and 8. In other respects, the display case of FIG. 3 is substantially identical to the case illustrated in FIGS. 1 and 2, above.

In FIGS. 1–3 upper edge trim members 76 can be employed for the side wall 78.

The island type case described with respect to FIG. 3 is of particular interest with respect to maintaining the temperatures in display spaces 6 and 8 at different temperatures so that different types of products can be stored therein. Thus, for example, frozen foods such as vegetables, juices, and the like may be stored in display space 6 and maintained at a desired temperature below 32° F. but above 0° F.; whereas ice cream may be stored in display space 8 at a temperature maintained below about 0° F.

Figure 4:
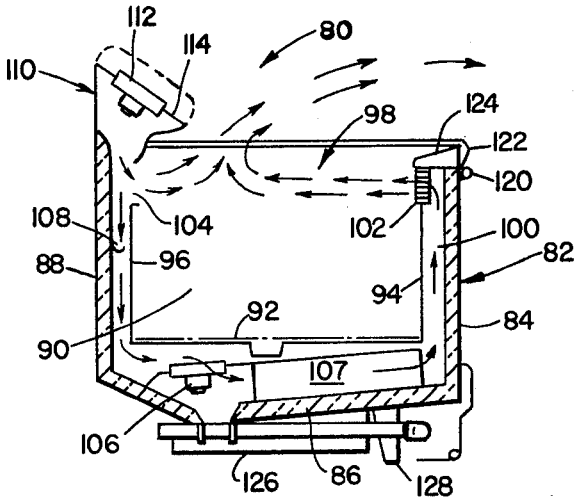
FIG. 4 is a schematic cross-sectional view of a single well type display case shown in a defrost cycle.

FIG. 4 shows a third embodiment of the invention used in an open well case having a single display space of the type that would normally be located against a wall in the food store. In this embodiment, the display case, generally designated 80, has an outer cabinet 82 comprised of a front wall 84, a bottom 86, and a back 88. The outer cabinet 82 contains a storage/display space 90, separated from the outer cabinet 82 by bottom wall panel 92 and side wall panels 94 and 96, respectively, and by a top access opening 98. A main or primary air conduit 100 is formed in the space between the outer cabinet 82 and bottom and side wall panels 92–96 of display space 90. An outlet 102, usually covered by a louvered grille, is disposed near the top of display space 90 along one side of access opening 98. A corresponding return or inlet opening 104 is located across from outlet 98. One or more fans 106 and a set of refrigeration coils 107 are located in conduit 100.

A rear air flue 108 is formed between side wall panel 96 and back cabinet wall 88. An air plenum housing 110 is constructed at the top of air flue 108 and a set of defrost ambient air fans 112 are arranged therein by a bracket 114. A perforated cover 116 is provided to cover the fan set and to admit ambient air. The fan set 112 operates to selectively draw ambient air from above the outer cabinet 80 into the air flue conduit 108 during a defrost cycle.

During the normal refrigeration cycle, fans 112 are shut off and fans 106 generate and maintain a continuous air band through conduit 100 and air flue 108, and an air curtain across the open top of display space 90. In many commercial installations, the refrigeration cycle air flow direction is substantially clockwise, referring to the orientation of FIG. 4; that is, air flows out of opening 104, across the case from back to front and enters inlet 102. For such cases the defrost cycle of operation of the display case shown in FIG. 4 is essentially the same as for the case shown in FIGS. 1 and 2, except that fans 106 are reversed at the start of the defrost cycle, concurrently with the start up of fans 112, to reverse the direction of air flow through conduits 100 and air flue 108 during the defrost cycle. Obviously, the invention described with respect to FIG. 4 could also be used for cases in which the normal refrigeration cycle air flow direction is the opposite to that described above, in which case reversal of fans 106 at the start of the defrost cycle would not be necessary.

The display case of FIG. 4 can be fitted with conventional guard bumpers 120, rub rails 122, conduit caps 124, drainage tubes 126, and feet 128 similarly to the cases of FIGS. 1–3.

A single well multiband open top display case incorporating the above mentioned clockwise air flow (referring to the orientation of FIG. 4) during refrigeration is shown in my U.S. Pat. No. 4,106,305, assigned to the same assignee as the present invention. In such cases the coldest air during the refrigeration cycle is delivered to the front edge of the top access opening.

The invention is also applicable to multiband open top display space cases of both single and double well construction. Such cases operate in substantially the same way as the cases described with respect to FIGS. 1–4 in that the air band flow directions in the primary air conduits are in the same direction as those FIGURES described herein. In such cases, the secondary air conduit provides for circulation of an air guard band which is not refrigerated but which flows in the same direction as the primary air band. Such multiple air conduit display cases are illustrated in my copending application U.S. Ser. No. 226,768 which has been incorporated herein by reference above.

Figure 5:
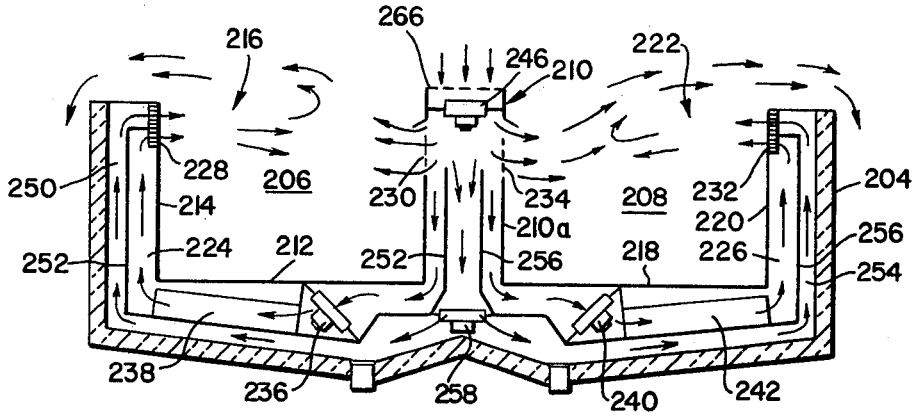
FIGS. 5 and 6 are schematic cross-sectional views of other embodiments of the display case according to the present invention wherein guard air band conduits are provided.
Figure 6:
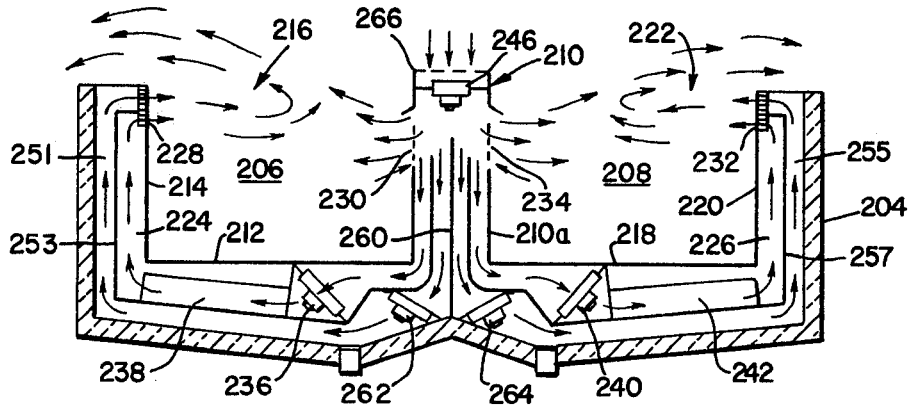

FIGS. 5 and 6 are variations of fourth and fifth embodiments of this inventions used in conjunction with multiband island type display cases. In these FIGURES, similar elements corresponding to those shown in the embodiment of FIGS. 1 and 2 and described above are designated by like reference numerals in the 200 series; thus outer cabinet 204 shown in FIGS. 5 and 6 corresponds to outer cabinet 4 in FIG. 1, display spaces 206 and 208 in FIGS. 5 and 6 correspond to display spaces 6 and 8, respectively, in FIG. 1, etc.

The inner or primary conduits 224 and 226 and their associated fans 236 and 240 and refrigeration coils 238 and 242 correspond to the single conduits 24 and 26 and their associated fans 36 and 40 and refrigeration coils 38 and 42, respectively, shown with respect to the single band embodiment of FIGS. 1 and 2. The multiband cases shown in FIGS. 5 and 6 are described hereafter only with respect to the defrost operation, the air flow direction of which is designated by the arrows in these FIGURES. A description of the refrigeration operation can be found in the above-mentioned U.S. Pat. No. 4,314,457 in reference to FIGS. 7 and 8.

In the embodiment shown in FIG. 5, a first guard band conduit 250 is formed in the space between the outer cabinet 204 and a conduit divider 252. Primary conduit 224 is defined between the divider 252 and the bottom and side walls 212 and 214 of display space 206. A second guard band conduit 254 is formed in the space between the outer cabinet 204 and a divider 256. Primary band conduit 226 is formed in the space between the divider 256 and the bottom and side walls 218 and 220 of display space 208. Both guard band conduits 250 and 254 share a common return defined between upward extensions of dividers 252 and 156 in the lower part of 210*a* of central column 210. A single set of guard band fans 258, preferably and advantageously located at the junction of guard band conduits 250 and 254, draws air from inlets 230 and 234, down through the inner portion of central column 210 between the upward dividers 252 and 256, into the through conduits 250 and 254, through outlets 228 and 232, and across top access openings 216 and 222 in the form of respective secondary or guard air curtains.

Similar to FIGS. 1–3, a series of ambient air fans 246 are mounted in the top portion of the central column 210 under air grille 266. These fans are mounted at about the same vertical height position as are the top portions of the walls of the outer cabinet 204. Ambient air fans 246 create both a downward flow of ambient air in the central column 210 and the ambient air streams which flow through the air openings 230 and 234 and thereby collide with the defrost ambient air streams being propelled through the air openings 228 and 232 across the tops of display spaces 206 and 208. The remainder of the ambient air stream created by the coaction of ambient air fans 246 and the bottom positioned guard band fans 258 flows downwardly into the guard band conduits 250 and 254 as well as in the primary air conduits 224 and 226.

Single and multiband common return cases, of the type shown in FIGS. 1, 2 and 5, are generally used where the temperatures of the respective display spaces within the main outer cabinet are to be maintained substantially the same.

FIG. 6 shows a multiband island type case in which the temperatures of the respective display spaces 206 and 208 may be maintained independently so that different types of products can be stored in the separate display spaces. Thus, for example, frozen foods such as vegetables, juices, and the like, may be stored in display space 206 and maintained at a desired temperature below 32° F. but above 0° F.; whereas, ice cream may be stored in display space 208 at a temperature maintained below about 0° F.

In FIG. 6, a first guard band conduit 251 extends around display space 206 and is separated from primary conduit 224 by a divider 253. A second guard band conduit 255 extends around display space 208 and is separated from primary conduit 226 by a divider 257. The return portions of conduits 251 and 255 extending up into column 210 are separated from each other by a center divider member 260. In addition, a first set of guard band fans 262 is located in conduit 251 to propel air through conduit 251 and across access opening 216 in the form of a first guard band curtain. A second set of guard band fans 264 is located in conduit 255 to propel air through conduit 255 and across top access opening 222 in the form of a second guard band curtain.

The multiband cases shown in FIGS. 5 and 6 operate in essentially the same way in the defrost cycle as the single band case shown in FIGS. 1 and 2. If desired, the guard band fans (fans 258 in FIG. 5 and fans 262, 264 in FIG. 6) may be shut off during the defrost cycle when fans 246 are turned on. In this way, the bulk of the ambient air not directed out of inlets 230 and 234 will be drawn substantially only into the primary band conduits 224 and 226 due to the suction created by fans 236 and 240, respectively, to defrost coils 238 and 242.

The display case shown in FIG. 6 is also equipped with a set of ambient air fans 246 which are mounted in the top portion of the central column 210 under a perforated air grille 266. Fans 246 provide the same ambient air intake function as described above with respect to FIG. 5, except that the ambient air flowing downwardly in the mid-portion of central column 210 is divided by the center divider member 260 into two guard air bands which flow in guard band conduits 251 and 255, respectively.

The electrical circuits for turning on the defrost fans 46, 112 and 246, at the start of a defrost cycle, for changing the speed of fans 36, 40, 106, 236, 240 and 258, as desired, or for reversing fans 106, as necessary, are well known in the art and would be readily apparent to one skilled in the design and construction of commercial refrigeration apparatus. One such circuit adaptable for use with the present invention is shown in FIG. 3 of my U.S. Pat. No. 4,265,092. It would be readily apparent to one skilled in the art to electrically connect fans 46, 112 and 246, in place of the supplemental heater in such a circuit as shown in the aforementioned patent.

The refrigerated display case above-described is characterized by a number of useful aspects. The defrost air flow shown in each of these cases is in the same direction through the primary air conduit as is the air flow during a refrigeration cycle. This aspect permits construction of the cases without two-way, reversible air fans which would be required if the air streams were required to be reversed in order to effect defrosting. Another aspect is that the configuration of the bottom walls and the inverted V-shaped bottom portions of FIGS. 1–3 permit efficient drainage of the water formed during the defrost cycle through the drainage tubes 66. The same can be said for the case illustrated in FIG. 4. It will also be noted that the absence of a central elevated shelf structure in the island type cases illustrated in FIGS. 1–3 permits customers to see the products in both of the display spaces from either side of the case. The increased volume of air flow employed during a defrost cycle can be from 25% to 50% greater than during the refrigeration cycle in each of the cases described herein in order to raise the efficiency of the defrost operation.

Open top display cases of the type described herein are usually less than 40 inches in height and are thus surrounded by fairly low temperature air in supermarkets of from 55° F. to 65° F. This temperature can drop to as low as 50° F. during the night time hours. Such low temperatures necessitate the forceful induction of ambient air from the space above the cases in order to effect efficient air defrosting. The coaction of the ambient air intake fans located at the top of the central columns and the internal air circulation fans mounted in the bottom portions of the air conduits provides a low cost but effective means to draw in ambient air from above the display cases. The cooperation of these fan means enables a higher volume of air to be forced through the iced coils in the defrost cycle than flows through the coils during the refrigeration cycle and at the same time to form a colliding air band pattern over the tops of the access openings in order to force the defrost ambient air away from the cases so that the same falls to the outside of the outer cabinets 4, 48 and 204 illustrated in the various FIGURES.

The invention may be embodied in other specific forms without departing from the spirit or essential characteristics thereof. The present embodiments are, therefore, to be considered in all respects as illustrative and not restrictive, the scope of the invention being indicated by the appended claims rather than by the foregoing description, and all changes which come within the meaning and range or equivalency of the claims are therefore intended to be embraced therein.

What is claimed is:

1. A refrigerated display case, comprising:

an open top cabinet containing at least one well type display space;

primary air conduit means in said cabinet extending around said display space, said primary conduit means containing refrigeration coil means;

defrost ambient air intake means in air flow communication with said primary conduit means;

first air opening means and second air opening means formed in said primary conduit means and located on opposite sides of said display space;

main air circulating means for circulating air through said primary conduit means and across the open top of said display space during refrigeration cycle between said first and second air opening means in the form of an air curtain;

defrost air circulating means located in said ambient air intake means;

defrost control means for energizing said defrost air circulating means at the start of a defrost cycle to move ambient air into said defrost ambient air intake means, a first portion of said ambient air being directed out of said intake means and out of one of said air opening means substantially in the opposite direction to the flow of the air curtain to collide with said air curtain, at least a portion of said air curtain being thereby reversed and caused to flow over the top of and outside the display case, and a further portion of said ambient air being drawn into said primary conduit means by said main air circulating means to flow through said primary conduit means and over said refrigeration coil means and to be discharged through the other of said air openings.

2. A refrigerated display case according to claim 1, wherein:

said defrost ambient air intake means comprises an air plenum housing having said defrost air circulating means mounted therein at approximately the height of the cabinet sides.

3. A refrigerated display case according to claims 1 or 2, wherein:

said defrost ambient air intake means is arranged in air flow communication with a vertical section of said primary air conduit means.

4. A refrigerated display case according to claim 3, wherein:

said defrost ambient air intake means is integrally formed with a top portion of a rear wall of said cabinet.

5. A refrigerated display case according to claim 3, wherein:

during a defrost cycle, said defrost air circulating means maintains a pressure differential in said second air opening means sufficient to create said flow of ambient air out of said opening means for collision with said air curtain.

6. A refrigerated display case according to claims 1 or 2, wherein:

during a defrost cycle, said defrost air circulating means maintains a pressure differential in said second air opening means sufficient to create said flow of ambient air out of said opening means for collision with said air curtain.

7. A refrigerated display case according to claim 1, wherein:

said main air circulating means propels said air curtain from said first air opening means to said second air opening means in the form of an air curtain during a refrigeration cycle; and wherein, said defrost ambient air intake means is located in air flow communication with said second air opening means in order to propel ambient air therefrom in the opposite direction to the flow of the air curtain during a defrost cycle to collide with said air curtain.

8. A refrigerated display case according to claim 1, wherein:

said main air circulating means propels said air curtain from said second air opening means to said first air opening means during a refrigeration cycle in the form of an air curtain; and wherein, said defrost ambient air intake means is located in air flow communication with said second air opening means; and wherein, said defrost control means further comprises:

means for reversing the direction of said main air circulating means during a defrost cycle to thereby direct the flow of air through said primary air conduit means in substantially the opposite direction compared to the refrigeration cycle, and wherein a portion of said ambient air drawn into said defrost ambient air intake means from above said display case by said defrost air circulating means during defrost is directed out of said second air outlet opening means to collide with said air curtain.

9. A refrigerated display case according to claim 1, wherein:

an air guard band conduit is disposed about said primary air conduit means within said cabinet;

said defrost ambient air intake means is in air flow communication with a portion of said guard air band conduit;

air opening means located in each terminal end of said guard air band conduit and located on opposite sides of said display space;

guard air band circulating means for circulating an air band through said guard air band conduit means and across the open top of said display space to the outside of said air curtain;

said defrost control means further comprising: means for selectively energizing said guard air band circulating means during refrigeration and defrost cycles.

10. A refrigerated display case according to claim 1, wherein:

said refrigerated display case comprises an open top cabinet containing two well type display spaces and wherein said primary air conduit means extends partially around both of said display spaces;

said defrost ambient air intake means in air flow communication with said primary conduit means of both of said display spaces;

first air opening means and second air opening means formed in end portions of both of said primary conduit means; and said main air circulating means enabling the flow of air through both of said primary conduit means and across the open top of said display spaces during a refrigeration cycle between said first and second air opening means of both of said primary conduit means in the form of two air curtains.

11. A refrigerated display case according to claim 10, wherein:

guard air band conduits are disposed about said primary air conduits of both of said wells and are arranged for the formation of guard air bands positioned to the outside of said air curtains during a refrigeration cycle.

12. A refrigerated display case, comprising:

an open top cabinet containing a well type region;

air flue means positioned in said well type region between opposite sides of said cabinet to divide said well type region horizontally into separate first and second open top product display spaces;

first air conduit means extending partially around said first display space within said cabinet and integrally joined to said air flue means, said first air conduit means containing first refrigeration coils means;

first air outlet means and first air inlet means of said first air conduit means located on opposite sides of said first display space;

second air conduit means extending around said second display space within said cabinet and integrally joined to said air flue means, said second air conduit means containing second refrigeration means;

second air outlet means and second inlet means of said second air conduit means located on opposite sides of said second display space, wherein said first and second inlet means are located in said air flue means;

main air circulating means for circulating air through said first and second conduit means, respectively, and across the open tops of said first and second display spaces between the respective outlet means and inlet means in the form of respective air curtains during a refrigeration cycle;

defrost ambient air intake means in air flow communication with said air flue means;

defrost air circulating means located in said defrost air intake means above said respective first and second inlet means; and defrost control means for energizing said defrost air circulating means at the start of a defrost cycle to draw ambient air into said defrost air intake means, first and second portions of said ambient air being directed out of said first and second inlet means to collide with said first and second air curtains flowing toward said first and second inlet means, respectively, at least portions of said air curtains being thereby reversed and caused to flow over the top of and outside the display case, and a further portion of said ambient air being drawn into said first and second conduit means by said main air circulating means to flow through said main air circulating means to flow through said main air circulating means to flow through said first and second conduit means and over said first and second refrigeration coil means.

13. A refrigerated display case according to claim 12, wherein:

said defrost ambient air intake means comprises an air plenum housing having said defrost means air circulating means mounted therein at the height of the cabinet sides.

14. A refrigerated display case according to claim 12 or 13, wherein:

during a defrost cycle, said defrost air circulating means maintains a pressure differential in said inlet means sufficient to create said flow of ambient air out of said inlet for collision with said air curtains.

15. A refrigerated display case according to claim 12, wherein:

said air flue means is divided by a partition member into first and second flue conduits;

said first flue conduit connected in air flow communication with said first conduit means; and said second flue conduit connected in air flow communication with said second air conduit means.

16. A refrigerated display case according to claim 12, wherein:

guard air band conduits are positioned about said first and said second air conduit means and within said air flue means; and wherein, guard air band circulating means are disposed therein for circulating a guard air band which is disposed to the outside of said respective air curtains during a refrigeration cycle;

said defrost ambient air intake means in flow communication with said guard air band conduits;

said defrost air circulating means enabling portions of said ambient air to be directed out of said guard air band conduit to collide with air guard bands flowing toward said defrost air circulating means whereby at least portions of said guard air bands are thereby reversed and caused to flow over the top of and outside the display cases simultaneously with the reversal and flow of the first and second air curtains over the outside of the display case.

17. In a refrigerated display having an open top well type display space, primary air conduit means extending partially around said display space and containing refrigeration coil means, said primary conduit means have air outlet means located on opposite sides of said display space and said primary conduit means containing main air circulating means for circulating air through said primary conduit means and across the open top of said display space during a refrigeration cycle and between the outlet and the inlet means in the form of an air curtain to form a circulating refrigerated air band; the improvement comprising:

defrost ambient air intake means to enable air flow into said primary conduit means, defrost air circulating means located in said ambient air intake means, and defrost control means for energizing said defrost air circulating means at the start of a defrost cycle to enable movement of a first portion of ambient air through said defrost ambient air intake means and into said circulating air band in the direction of the flow thereof, said defrost ambient air intake means enabling a second portion of ambient air being directed in a direction substantially opposite to the flow of the air curtain to collide with said air curtain and for enabling at least a portion of said air curtain to be thereby reversed and caused to flow away from said display case.

18. The improvement according to claim 17, wherein:

said defrost ambient air intake means comprises an air plenum housing having said defrost air circulating means mounted therein at approximately the height of the cabinet size.

19. The improvement according to claim 17, wherein:

said defrost ambient intake means is arranged in air flow communication with a vertical section of said primary air conduit means.

20. The improvement according to claim 17, wherein:

said defrost ambient air intake means is integrally formed with a top portion of a rear wall of said cabinet.

21. A method of defrosting a well type open top refrigerated display case having at least an access opening and having primary air conduit means containing refrigeration coils, primary air circulating means, defrost air intake means, and defrost air circulating means located in said defrost air intake means and communicating with said primary air conduit means, comprising the steps of:

operating said primary air circulating means to cause air to flow through said primary air conduit means, across said coil and across the open top of said display case;

operating said defrost air circulating means during defrost cycle to draw ambient air from approximately the vertical level of the access opening into said defrost air intake means from above said case; and directing a portion of said ambient air out of said defrost air intake means in the opposite direction to the primary flow of air directed across said open top by said primary air circulating means to collide with said primary air flow and to reverse and redirect said primary air flow over the top of and outside the display case.

22. A method according to claim 21, further comprising the step of:

drawing a further portion of said ambient air into said primary conduit upstream of said refrigeration coils and directing said further portion of ambient air across said refrigeration coils.

23. A method according to claim 22, further comprising the step of:

maintaining the air pressure in said defrost air intake means during a defrost cycle sufficiently greater than the air pressure in the display case to create said flow of ambient air out of said defrost conduit means for collision with said air curtain.

24. A method according to claims 21 or 23, in which an air flue means is positioned in said display case to divide said well into separate first and second open top display spaces with respective first and second primary air conduit means, each communicating with the defrost air intake means, said method comprising the further step of:

directing substantially equal portions of said ambient air out of said defrost air intake means to collide with respective air flows across the open tops of said first and second display spaces.

* * * * *

UNITED STATES PATENT AND TRADEMARK OFFICE

CERTIFICATE OF CORRECTION

PATENT NO. : 4,439,992

DATED : April 3, 1984

INVENTOR(S) : Fayez F. Ibrahim

It is certified that error appears in the above-identified patent and that said Letters Patent is hereby corrected as shown below:

Column 12, Line 52, delete "through said main air circulating means to flow".

Signed and Sealed this

*Fifth* Day of *February 1985*

[SEAL]

*Attest:*

DONALD J. QUIGG

*Attesting Officer*

*Acting Commissioner of Patents and Trademarks*